US008544033B1

(12) United States Patent
Acharya et al.

(10) Patent No.: US 8,544,033 B1
(45) Date of Patent: Sep. 24, 2013

(54) SYSTEM AND METHOD FOR EVALUATING CONTENT IN A DIGITAL SIGNAGE ENVIRONMENT

(75) Inventors: Sridhar Acharya, Fremont, CA (US); Gregory Kozakevich, Los Altos, CA (US); Panos N. Kozanian, Fremont, CA (US); Sofin Raskin, Half Moon Bay, CA (US)

(73) Assignee: Cisco Technology, Inc., San Jose, CA (US)

( * ) Notice: Subject to any disclaimer, the term of this patent is extended or adjusted under 35 U.S.C. 154(b) by 405 days.

(21) Appl. No.: 12/642,796

(22) Filed: Dec. 19, 2009

(51) Int. Cl.
*H04H 60/33* (2008.01)
*H04H 60/56* (2008.01)
*H04H 60/32* (2008.01)

(52) U.S. Cl.
USPC ..... 725/12; 725/9; 725/10; 725/19

(58) Field of Classification Search
USPC ..... 725/9
See application file for complete search history.

(56) References Cited

U.S. PATENT DOCUMENTS

| | | | | |
|---|---|---|---|---|
| 5,446,891 | A | 8/1995 | Kaplan et al. | |
| 5,481,294 | A * | 1/1996 | Thomas et al. | 725/20 |
| 5,724,567 | A | 3/1998 | Rose et al. | |
| 5,983,214 | A | 11/1999 | Lang et al. | |
| 6,182,068 | B1 | 1/2001 | Culliss | |
| 6,453,345 | B2 | 9/2002 | Trcka et al. | |
| 6,873,258 | B2 | 3/2005 | Marples et al. | |
| 7,379,992 | B2 | 5/2008 | Tung | |
| 7,386,517 | B1 | 6/2008 | Donner | |
| 7,415,516 | B1 | 8/2008 | Gits et al. | |
| 7,573,833 | B2 | 8/2009 | Pirzada et al. | |
| 7,586,877 | B2 | 9/2009 | Gitz et al. | |
| 7,752,190 | B2 | 7/2010 | Skinner | |

(Continued)

FOREIGN PATENT DOCUMENTS

| | | |
|---|---|---|
| EP | 0837583 | 4/1998 |
| EP | 1199899 A1 | 4/2002 |

(Continued)

OTHER PUBLICATIONS

Daniel Parisien, "The Dirty Little Secret of Digital Signage: Proof of Play vs. Audited Proof of Display," http://blog.broadsign.com/digitalsignagedigest/index.php/2007/10/19/the-dirty-little-secret-of-digital-signage-proof-of-play-vs-audited-proof-of-display; Oct. 19, 2007; 5 pages.

(Continued)

*Primary Examiner* — Justin Shepard
(74) *Attorney, Agent, or Firm* — Patent Capital Group

(57) ABSTRACT

An apparatus is provided in one example and includes a memory element configured to store data, a processor operable to execute instructions associated with the data, and a recording module configured to record video data associated with a display, and record individual data associated with one or more audience members witnessing the video data on the display. The video data and the individual data are recorded in a substantially concurrent manner, and the video data and the individual data are communicated over a network to a next destination. In a more particular embodiment, the apparatus includes a server configured to communicate programming instructions for recording the video data. A camera is configured to record the video data and the individual data based on the programming instructions, and the camera interfaces with an optical element that reflects at least a portion of the video data and the individual data.

14 Claims, 3 Drawing Sheets

(56) References Cited

U.S. PATENT DOCUMENTS

| | | | | |
|---|---|---|---|---|
| 7,853,967 | B2 * | 12/2010 | Yoon et al. | 725/9 |
| 7,975,283 | B2 * | 7/2011 | Bedingfield, Sr. | 725/95 |
| 8,259,692 | B2 | 9/2012 | Bajko | |
| 2002/0050927 | A1 | 5/2002 | De Moerloose et al. | |
| 2003/0110485 | A1 * | 6/2003 | Lu et al. | 725/9 |
| 2005/0114788 | A1 | 5/2005 | Fabritius | |
| 2005/0139672 | A1 * | 6/2005 | Johnson et al. | 235/454 |
| 2005/0216572 | A1 | 9/2005 | Tso et al. | |
| 2008/0050111 | A1 * | 2/2008 | Lee et al. | 396/429 |
| 2008/0065759 | A1 | 3/2008 | Gassewitz | |
| 2008/0098305 | A1 | 4/2008 | Beland | |
| 2008/0122871 | A1 | 5/2008 | Guday | |
| 2008/0215428 | A1 | 9/2008 | Ramer et al. | |
| 2009/0132823 | A1 | 5/2009 | Grimen et al. | |
| 2009/0144157 | A1 | 6/2009 | Saracino et al. | |
| 2009/0150918 | A1 | 6/2009 | Wu | |
| 2009/0177528 | A1 * | 7/2009 | Wu et al. | 705/10 |
| 2010/0121567 | A1 | 5/2010 | Mendelson | |
| 2010/0214111 | A1 | 8/2010 | Schuler et al. | |
| 2010/0304766 | A1 | 12/2010 | Goyal | |
| 2011/0062230 | A1 | 3/2011 | Ward et al. | |
| 2011/0099590 | A1 | 4/2011 | Kim et al. | |
| 2012/0007713 | A1 | 1/2012 | Nasiri et al. | |
| 2012/0072950 | A1 | 3/2012 | Wu et al. | |
| 2012/0095812 | A1 | 4/2012 | Stefik et al. | |
| 2012/0135746 | A1 | 5/2012 | Mohlig et al. | |
| 2012/0178431 | A1 | 7/2012 | Gold | |
| 2012/0208521 | A1 | 8/2012 | Hager et al. | |
| 2012/0284012 | A1 | 11/2012 | Rodriguez et al. | |

FOREIGN PATENT DOCUMENTS

| | | | |
|---|---|---|---|
| EP | 2067342 | A2 | 6/2009 |
| GB | 2326053 | | 12/1998 |
| WO | WO 9808314 | | 2/1998 |
| WO | WO 0022860 | | 4/2000 |
| WO | WO 2006/053275 | | 5/2006 |
| WO | WO 2008/032297 | | 3/2008 |
| WO | WO 2011/153222 | | 12/2011 |

OTHER PUBLICATIONS

Joseph Grove and Bill Yackey, "Digital Signage Expo Featured Exhibitors: The hardware providers," www.digitalsignagetoday.com/article.php?id=21812; Mar. 4, 2009; 3 pages.

Evan Blass, "Apple patent embeds thousands of cameras among LCD pixels," http://www.engadget.com/2006/04/26/apple-patent-embeds-thousands-of-cameras-among-lcd-pixels; Apr. 26, 2006; 1 page.

Nuva Technology, Inc., "AVITAR DSN Software Solution," www.nuvatech.com/avitar.html; printed Dec. 14, 2009; 2 pages.

Axis Communications, "Security Capabilities," www.axis.com/products/video/about_networkvideo/security_capabilities.htm; printed Dec. 14, 2009; 1 page.

Ben Burfordon, "Third day in Rio—part 3, Sugarloaf," http://www.davisdenny.com/bensblog/2008/11/third-day-in-riopart-3-sugarlo.htrn1; Nov. 17, 2008; 29 pages.

U.S. Appl. No. 12/396,124 filed, filed Mar. 2, 2009, entitled "Digital Signage Proof of Play," Inventor(s): Robert M. Brush et al.

Broadband, "Ask DSLReports.com: What is NebuAD?," Feb. 12, 2008, retrieved and printed Jun. 3, 2010, 17 pages; http://www.dslreports.com/shownews/Ask-DSLReportscom-What-Is-NebuAD-91797.

"Cisco Digital Signs," Cisco Digital Media Manager, cisco.com; 2 pages.; [Retrieved and printed Sep. 12, 2012] http://www.cisco.com/en/USprod/video/ps9339/ps6681/digital_signs.html.

Richardson, Iain, "An Overview of H.264 Advanced Video Coding," Vcodex/OneCodec White Paper, Jan. 2011, © Iain Richardson/Vcodex, Ltd. 2007-2011; 7 pages http://www.vcodex.com/files/H.264overview_Jan11.pdf.

Richardson, Iain, "H.264/AVC Loop Filter," Vcodex White Paper, © Iain Richardson/Vcodex, Ltd. 2002-2011; 3 pages; http://www.vcodex.com/files/H264_loopfilter_wp.pdf.

Richardson, Iain, "Introduction to Image and Video Coding," © Iain Richardson/Vcodex, Ltd. 2001-2002; 35 pages; http://www.vcodex.com/files/videocoding_intro_1.pdf.

Richardson, Iain, "Video Coding Walk-Through," White Paper, © Iain Richardson/Vcodex, Ltd. 2011; 10 pages.

Wikipedia, "NebuAd," retrieved and printed Jun. 3, 2010, 11 pages; http://en.wikipedia.org/wiki/NebuAd.

"3D Drawing in Augmented Reality," posted by String, Digital Graffiti on vimeo.com; [printed Dec. 1, 2011] 2 pages http://vimeo.com/groups/digitalgraffiti/videos/15935674.

"Akoo Bridges Digital and Cell Phone Screens," Blog at WordPress.com [printed on Oct. 24, 2011] 4 pages; http://screenmedia.wordpress.com/2008/02/25/akoo-bridges-digital-and-cell-phone-screens.

"iPhone Opens Hotel Doors—OpenWays Presents its iPhone Application to Bypass Front Desks and Open Room Locks ," Hotel News Resource, Mar. 2, 2010, 6 pages http://www.hotelnewsresource.com/article44075.html.

"Nearest Tube Augmented Reality App for iPhone 3GS from acrossair," video uploaded to YouTube by acrossair on Jul. 6, 2009, 2 pages http://www.youtube.com/watch?v=U2uH-jrsSxs.

"Tonchidot Announces the Launch of Sekai Camera, A Social Augmented Reality App for iPhone," posted by whatz in WhatAboutMacs forum, [printed Dec. 5, 2011], 2 pages http://forums.whataboutmac.com/topic.php?id=1164.

Anderson, Steve, "Smartphone as Hotel Room Key?" TFTS High Tech News Portal, Nov. 2, 2010, 6 pages http://nexus404.com/Blog/2010/11/02/smartphone-as-hotel-room-key-assa-abloy-swedish-door-opening-company-working-on-nfe-smartphone-enabled-door-keys/.

CAYIN Technology Co., Ltd., "Interactive Digital Signage—Integration with Touch Screen & Mobile Devices," [printed Oct. 24, 2011] 2 pages http://cayintech.com/digital_signage_solutions/interactive_digital_signage.

CAYIN Technology Co., Ltd., "SMP-WEB4 Web-Based Digital Signage Media Player," Product Information and Brochure; [printed Dec. 1, 2011] 4 pages http://cayintech.com/digital_signage_products/digital_signage_player.

Digital Signage Companies, "Company Showcase," DigitalSignageToday.com, 4 pages, [Retrieved and printed Apr. 23, 2012]; http://www.digitalsignagetoday.com/showcases.php.

Duryee, Tricia, "Mobile Maps are Moving Indoors to Pinpoint Specific Items on Store Shelves," mocoNews.net, Aug. 25, 2010, 1 page http://moconews.net/article/419-mobile-maps-are-moving-indoors-to-help-navigate-within-stores-airports/.

Eaton, Kit, "Foursquare's Digital Graffiti, a Legally Nerve-Wracking Taste of the Future," FastCompany.com, Apr. 2, 2010, 2 pages; http://www.fastcompany.com/1605224/foursquare-virtual-graffiti-geotagging-tagsaugmented-reality-lbs.

Gutzmann, Kurt, "Access Control and Session Management in the HTTP Environment," IEEE Internet Computing, Jan.-Feb. 2001.

Horowitz, Michael, "What does your IP address say about you?", CNET News, Sep. 15, 2008; 13 pages; http://news.cnet.com/8301-13554_3-10042206-33.html.

Information Sciences Institute, University of Southern California, "RFC 793: Transmission Control Protocol—DARPA Internet Program Protocol Specification," prepared for Defense Advanced Research Projects Agency, now maintained by the Internet Engineering Task Force, Sep. 1981; 92 pages.

Phorm, Inc., "Consumers Publishers & Networks Advertisers & Agencies ISPs: A personalised internet experience," retrieved and printed Jun. 3, 2010, 2 pages; http://www.phorm.com/.

POPAI, "Digital Signage Network Playlog Standards," Version 1.1, POPAI Digital Signage Standards Committee, William Wu, Editor-in-Chief, Aug. 23, 2006, 17 pages; http://www.popai.com/docs/DS/POPAI%20Digital%Digital%20Signage%20Playlog%20Standard%20-%20Version1.1a.pdf.

Ranveer, Chandra, et al., "Beacon Stuffing, WiFi without Associations," Powerpoint Presentation, [Printed on Dec. 5, 2011] 20 pages http://www.google.com/url?sa=t&rct=j&q=&esrc=s&source=web&cd=5&ved=OCEYQFjAE&url=http%3A%2F%2Fresearch.microsoft.com%2Fen-us%2Fprojects%2Fwifiads%2Fbeaconstuffinghotmobile.ppt &ei=6sm6TrCDEYmpiAK8hcGBBQ
&usg=AFQjCNFQbxbGV5KvqjswK3ODTUwumRFvJQ.
USPTO Sep. 11, 2012 Non-Final Office Action from U.S. Appl. No. 12/793,545.
USPTO Apr. 25, 213 Non-Final Office Action from U.S. Appl. No. 13/300,409.
PCT Dec. 4, 2012 International Preliminary Report on Patentability from PCT/US2011/038735; 7 pages.
Webster, Melissa, "Retail IT Meets Video: Cisco Makes Digital Signage Play Over the Network," Cisco White Paper; Jul. 2007; 14 pages http://www.cisco.com/en/US/solutions/collateral/ns340/ns394/ns158/ns620/net_implementation_white_paper0900aecd806b8c04.pdf.
USPTO Dec. 11, 2012 Response to Sep. 11, 2012 Non-Final Office Action from U.S. Appl. No. 12/793,545.
USPTO Jan. 8, 2013 Final Office Action from U.S. Appl. No. 12/793,545.
USPTO Apr. 4, 2013 RCE Response to Final Office Action mailed Jan. 8, 2013 from U.S. Appl. No. 12/793,545.
USPTO Mar. 13, 2013 Non-Final Office Action from U.S. Appl. No. 13/165,000.
USPTO Nov. 28, 2012 Non-Final Office Action from U.S. Appl. No. 13/165,123.
USPTO Feb. 28, 2013 Response to Non-Final Office Action mailed Nov. 28, 2012 from U.S. Appl. No. 13/165,123.
USPTO Mar. 25, 2013 Notice of Allowance from U.S. Appl. No. 13/165,123.
U.S. Appl. No. 12/793,545, filed Jun. 3, 2010, entitled "System and Method for Providing Targeted Advertising Through Traffic Analysis in a Network Environment," Inventors: Ravindranath C. Kanakarajan, et al.
U.S. Appl. No. 12/925,966, filed Nov. 3, 2010, entitled "Identifying Location Within a Building Using a Mobile Device," Inventor(s): Peter Michael Gits, et al.
U.S. Appl. No. 13/165,123, filed Jun. 21, 2011, entitled "Managing Public Resources," Inventor(s): Dale Seavey, et al.
U.S. Appl. No. 13/300,409, filed Nov. 18, 2011, entitled "System and Method for Generating Proof of Play Logs in a Digital Signage Environment," Inventors: Sriramakrishna Yelisetti, et al.
U.S. Appl. No. 13/165,000, filed Jun. 21, 2010, entitled "Delivering Wireless Information Associating to a Facility," Inventor(s) Peter Michael Gits, et al.
U.S. Appl. No. 13/335,078, filed Dec. 22, 2011, entitled, "System and Method for Providing Proximity-Based Dynamic Content in a Network Environment," Inventor(s): Peter Michael Gits, et al.
EPO May 2, 2001 European Search Report from Application No. EP00440277; 2 pages.
PCT Oct. 11, 2011 Transmittal of the International Search Report and Written Opinion of the International Searching Authority from PCT/US2011/038735; 14 pages.
PCT-Jul. 2, 2007 International Search Report from PCT/US05/41114; 2 pages.
PCT-Jul. 17, 2007 International Preliminary Report on Patentability and the Written Opinion of the International Searching Authority from PCT/US05/41114; 6 pages.

* cited by examiner

SYSTEM AND METHOD FOR EVALUATING CONTENT IN A DIGITAL SIGNAGE ENVIRONMENT

TECHNICAL FIELD

This disclosure relates in general to the field of digital signage and, more particularly, to evaluating content in a digital signage environment.

BACKGROUND

Advertising architectures have grown increasingly complex in communication environments. As advertising technologies increase in sophistication, proper coordination and efficient management of advertising content becomes critical. Typically, advertisers seek to confirm that their content was properly displayed from various locations. A network owner often forms a relationship that involves an advertiser, who seeks to broadcast particular content using the network owner's system displays. The ability to properly manage content transmissions and, further, to confirm that actual content broadcasting occurred presents a significant challenge to system designers, component manufacturers, advertising agencies, network owners/operators, and system administrators.

BRIEF DESCRIPTION OF THE DRAWINGS

To provide a more complete understanding of the present disclosure and features and advantages thereof, reference is made to the following description, taken in conjunction with the accompanying figures, wherein like reference numerals represent like parts, in which.

DETAILED DESCRIPTION OF EXAMPLE EMBODIMENTS

Overview

An apparatus is provided in one example and includes a memory element configured to store data, a processor operable to execute instructions associated with the data, and a recording module configured to record video data associated with a display and record individual data associated with one or more audience members witnessing the video data on the display. The video data and the individual data are recorded in a substantially concurrent manner, and the video data and the individual data are communicated over a network to a next destination. In a more particular embodiment, the apparatus includes a server configured to communicate programming instructions for recording the video data. A camera can be configured to record the video data and the individual data based on the programming instructions, and the camera can interface with an optical element that reflects at least a portion of the video data and the individual data. In one instance, the optical element is a convex mirror that is proximate to the display and that reflects images to be recorded by the camera. In other examples, a set-top box is configured to couple to the display, and the set-top box includes a digital media player configured to play content associated with the video data. In other examples, eye gaze metrics for one or more of the audience members are tracked.

Example Embodiments

Figure 1:
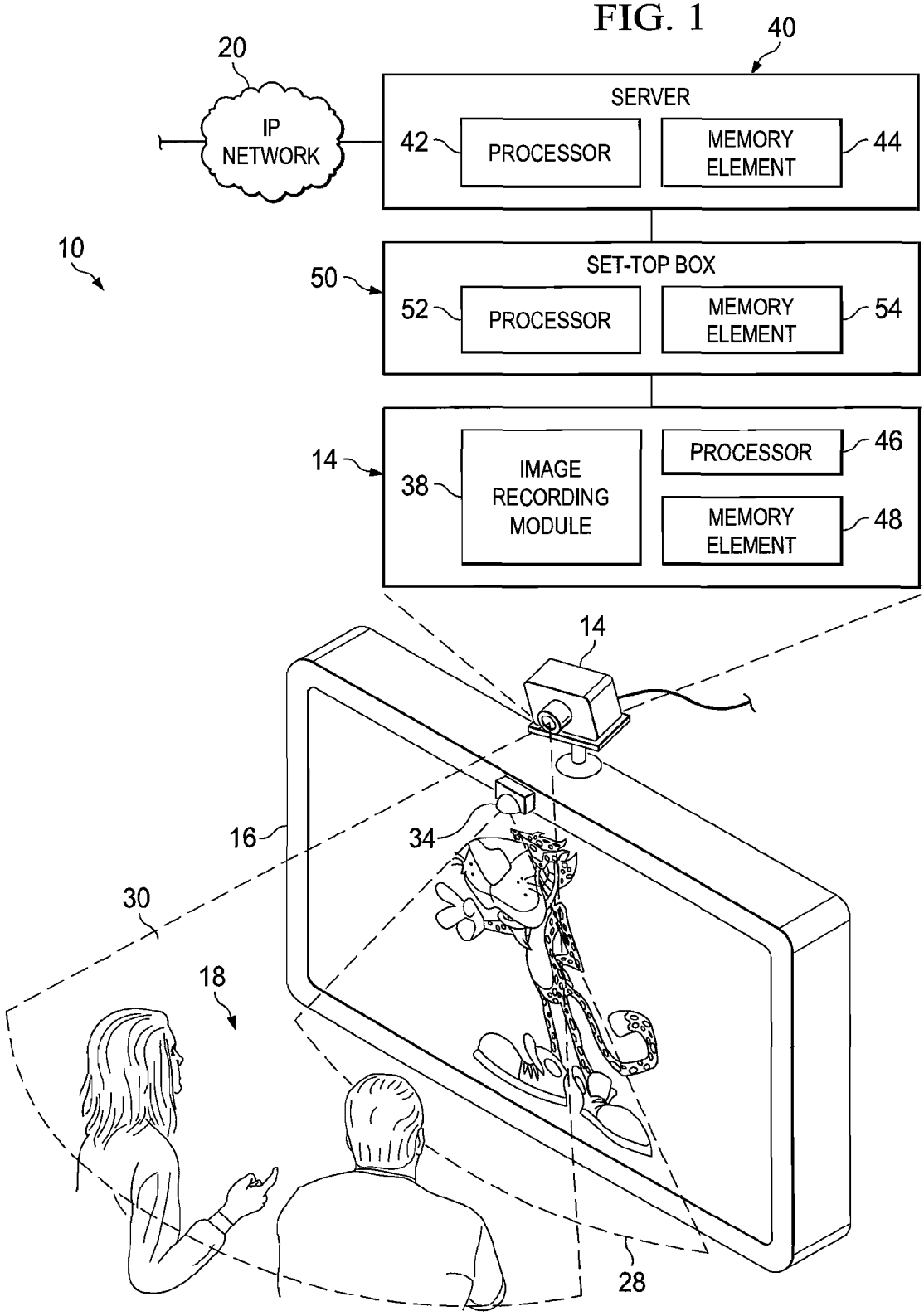
FIG. 1 is a simplified block diagram of a communication system for evaluating content in a digital signage environment in accordance with one embodiment of the present disclosure.

Turning to FIG. 1, FIG. 1 is a simplified block diagram of a communication system 10, which includes a camera 14, a display 16, one or more customers 18, an Internet protocol (IP) network 20, a first image 28, a second image 30, an optical element 34, a server 40, and a set-top box 50. Camera 14 may include an image recording module 38, a processor 46, and a memory element 48. Server 40 may include a processor 42 and a memory element 44. Set-top box 50 may include a processor 52 and a memory element 54.

For purposes of illustrating certain example techniques of communication system 10, it is important to understand the communications that may be occurring in an advertising environment. The following foundational information may be viewed as a basis from which the present disclosure may be properly explained. 'Proof of play' is the term used in digital signage to describe the summary playback reports and/or the raw play logs of content. Proof of play is the equivalent of tearsheets in newspapers or click-through reports in pay-per-click marketing. Proof of play should report which ads were actually displayed on each screen and when that broadcasting activity occurred. If one or more of the screens are off or disconnected from a digital player, the proof of play would not detect this condition. This leads to the wrong count of ad plays, a distorted count of impressions, and the wrong conclusions in a post-campaign analysis.

Proof of play is an important aspect for digital signage as a reporting tool. It is particularly important when used for advertising, as advertisers seek proof that their content played on a specific sign (e.g., at a specific time) with a certain amount of certitude. In regards to audited play logs, most digital signage playback devices produce raw play logs that track what ad played, the date it played, etc. In order to validate the accuracy of the entire reporting system, these play logs are commonly audited by a third party. Again, these audits theoretically register the content that was previously played on the actual screen, and then the results can be compared to the play logs.

Proof of play in the form of logs does not suffice because content being played by an endpoint does not guarantee that the screen was on, suitably positioned for consumers to see, unobstructed by surrounding elements, etc. In addition, the logs could indicate that certain content was playing but in actuality, the media content was incorrect, so the wrong digital sign was displayed. As a separate issue, proof of effectiveness is an audience metric and this can include eye gaze measuring metrics. It is most often captured by running analytic software on a video or an image. It can allow an advertiser to prove the effectiveness of their advertising by evaluating how many people witnessed and/or reacted to the advertisement.

Digital signage has a strong advantage over simple broadcast media (e.g., television programming) because it can (theoretically) account for every advertisement played on every screen. In digital signage, near real-time tracking of each advertisement playing can be made into an automated procedure. However, signage operators do not have the proper reporting mechanisms to provide appropriate accountability to the advertising marketers to whom they service. In operation of a typical digital signage activity, an advertiser would pay a fee to a network owner (e.g., an owner of various video displays capable of rendering advertisements) for showing the advertiser's content. In many scenarios, an advertising agency would broker this relationship such that content could be delivered to the advertising agency, which would contact various signage network owners for coordinating appropriate timeslots and locations to deliver the particular content. It would be impractical for the advertiser to verify each instance of his content being shown at various display locations. In some scenarios, the advertiser would only rely on a testament from the signage network owner as to whether his particular content was properly displayed. However, because of the large monetary expenditures incurred in many advertising environments, the advertiser may seek reliable proof that the paid-for content was actually shown. There can be various levels of proof of play in these scenarios. One level of proof of play may be as simple as providing a text log, which may include an electronic timestamp for when certain content was displayed. Unfortunately, such log information is easy to falsify and, oftentimes, erroneous.

Communication system 10 can resolve these issues (and others) in providing a single camera configuration that accommodates both a proof of play and a proof of effectiveness for associated content. In one example implementation, communication system 10 provides an easy to mount and non-obstructive camera, which utilizes a mirror in its operations. Communication system 10 can be configured to deliver a synchronized image of both digital signage proof of play and digital signage proof of effectiveness. In certain embodiments, the use of a single camera for both proof of play and proof of effectiveness makes for error-free synchronization, as opposed to a timestamp-based synchronization, which can be problematic for the reasons discussed above.

In addition, the integration of proof of play and proof of effectiveness into a single camera can provide an intelligent correlation between content being shown and content being observed by audience members. In essence, communication system 10 can mimic the user experience at a particular display site. For example, if there were some obstruction in front of the display, if the display were not functioning properly, if the display had paint on its surface, etc., the camera would capture these deficiencies. This is in contrast to other types of proof of play, which would incorrectly presume that the content was properly shown.

In conjunction with these confirming activities, a proof of effectiveness is also provided by communication system 10. The proof of effectiveness could measure how enjoyable, attractive, intriguing, compelling, or interesting the advertisement is for audience members. Some proof of effectiveness metrics can involve eye gazing analyses, facial recognition software, simple counting mechanisms that tally the number of people watching a particular advertisement, etc. All of this individual data can also be tracked per time interval, as the content is played. For example, communication system 10 can identify the number of people stopping or slowing down to watch the advertisement. Before turning to those details and some of the operations of this architecture, a brief discussion is provided about some of the infrastructure of FIG. 1.

In one particular example, camera 14 is an IP camera configured to record, maintain, cache, receive, and/or transmit data. This could include transmitting packets over IP network 20 to a suitable next destination. The recorded files could be stored in camera 14 itself, or provided in some suitable storage area (e.g., a database, server, etc.). In one particular instance, camera 14 is its own separate network device and has a separate IP address. Camera 14 could be a wireless camera, a high-definition camera, or any other suitable camera device configured to capture image information from display 16, as well as background (i.e., environment) image information relating to proof of effectiveness metrics.

Note that one problem associated with mounting a camera pointing to a screen is that it is a complex task, which often requires custom brackets to be installed by a trained professional. The second problem with camera installations is that (collectively) the custom brackets, the camera, and the wires are not aesthetically pleasing. This clumsy appearance presents an issue in retail environments, where décor is imperative. The third problem is that proof of play and proof of effectiveness should employ a camera, and both feeds for proof of play and proof of effectiveness require some type of synchronization. In order to effectively address these issues, camera 14 can be strategically mounted (e.g., on top of display 16 in a non-obstructive way) in order to minimize obstructing the view of display 16. In one example implementation, optical element 34 is a mirror that is mounted in front of camera 14 in order to reflect back content being shown on display 16.

In one example implementation, camera 14 can capture and record at least two images 28 and 30. One example implementation may include a top half of an image field being dedicated to proof of effectiveness, and a bottom half of the image field being dedicated to proof of play, which ensures that the particular content is being shown on display 16. In this particular example of FIG. 1, image 28 is associated with a proof of play for content being provided on display 16. Image 30 is associated with a proof of effectiveness of the content. Image 28 can be enhanced, magnified, adjusted, or otherwise modified by optical element 34. In one example implementation, optical element 34 is a round convex mirror that magnifies the image being shown on display 16. Using a convex mirror offers the effect of enlarging an image and, further, it can be positioned relatively close to the actual screen. In such an instance, the top half of the convex mirror could be dedicated to a proof of effectiveness for the audience (e.g., involving eye gaze, or other individual data), whereas the bottom half of the convex mirror would be dedicated to confirming content being rendered on display 16.

In one example implementation, half of a round convex mirror is provided approximately an inch away from camera 14, which can be configured on top of display 16. Alternatively, any suitable length, mounting, or positioning, can be used in order to appropriately place optical element 34 in relation to camera 14 and/or display 16. This particular configuration allows the mirror to face both camera 14 and display 16. [Note that a simple bracket can be used to help position optical element 34, which could be secured to camera 14 itself, to display 16, or to any other structural element in the surrounding environment.] In one example, the straight edge of the half circle can be aligned parallel to the edge of display 16 upon which camera 14 rests. Thus, a single non-obstructive camera could record both the content on the screen and the background image plane (e.g., capturing images associated with a passerby, an audience, etc.) in front of the screen. The bottom half of camera 14 can record the image on the screen by recording the reflection in the convex mirror, where the top half of camera 14 can record individual data (e.g., eye gazing metrics associated with audience members watching the screen). This configuration allows camera 14 to be dual purposed for both proof of play and proof of effectiveness. Such a configuration would also obviate the need for mounting awkward brackets (e.g., installed by a trained professional) to setup a proof of play camera.

In contrast to using multiple cameras synchronized by time stamps that can be prone to errors, using a single camera configured to generate a single image for both proof of play and proof of the effectiveness creates a higher perception of a direct correlation between displayed content and how individuals experienced the content. The recorded information may be used to confirm if the scheduled content was played (as intended) and reconcile the recorded data with the schedule log. In other instances, this image recording feature set can be used as a troubleshooting tool for on-demand logs, along with image and video playback.

Camera 14 can be configured to capture the outlined image data and send it to any suitable processing platform, or to server 40 attached to the network for processing and for subsequent distribution to remote sites. Server 40 could include an image-processing platform such as a media experience engine (MXE), which is a processing element that can attach to the network. The MXE can simplify media sharing across the network by optimizing its delivery in any format for any device. It could also provide media conversion, real-time postproduction, editing, formatting, and network distribution for subsequent communications. The system can utilize real-time face and eye recognition algorithms to detect the position of the participant's eyes in a video frame.

Any type of image synthesizer (e.g., within server 40, at a remote location, somewhere in the network, etc.) can process the video streams captured by camera 14 in order to produce a synthesized video that integrates proof of play and proof of effectiveness characteristics. The image synthesizer could readily process image data being captured by camera 14 from two different aspects, as detailed herein.

In another example operational flow, the system can utilize a face detection algorithm to detect a proof of effectiveness level associated with a particular customer. Other algorithms can be used to determine whether a given customer moves closer to display 16, slows down as he passes display 16, or quickly leaves the display environment (e.g., when a particular piece of content is played). Thus, these metrics can be synchronized with exact time intervals such that particular content can be evaluated as to its effectiveness, or potentially its unattractive qualities.

Display 16 offers a screen at which video data can be rendered for the end user. Note that as used herein in this Specification, the term 'display' is meant to connote any element that is capable of delivering an image, video data, text, sound, audiovisual data, etc. to an end user. This would necessarily be inclusive of any panel, plasma element, television, monitor, computer interface, screen, or any other suitable element that is capable of delivering such information. This could include panels or screens in sports venues (e.g., scoreboards, banners, jumboTrons, baseball fences, etc.), or on the sides of buildings (e.g., in Times Square in New York, or downtown Tokyo, and other urban areas, where advertising is prevalent), or vehicle advertisements (e.g., where a truck or other types of vehicles are tasked with trolling certain streets and neighborhoods to deliver advertising content). Note also that the term 'video data' is meant to connote any type of audio or video (or audio-video) data applications (provided in any protocol or format) that could operate in conjunction with display 16.

Customers 18 are individuals (e.g., possible audience members) within the proximity of display 16. Customers 18 can be shoppers in a retail environment, or pedestrians traversing particular walkways, aisles, etc. Customers 18 can have their individual data (e.g., inclusive of eye gazing activities, individual movements, facial recognition tracking, monitoring the number of individuals watching a particular advertisement, identifying when users move closer to display 16 or leave display 16, etc.) tracked. The individual characteristics for particular customers 18 can also be tracked at specific time intervals, as content is played via display 16. This would translate into an ability to identify/mark exactly when particular eye gazing occurred, or particular gatherings happened, as a particular piece of content was shown to an audience.

IP network 20 represents a series of points or nodes of interconnected communication paths for receiving and transmitting packets of information that propagate through communication system 10. IP network 20 offers a communicative interface between any of the components of FIG. 1 and remote sites, and may be any local area network (LAN), wireless local area network (WLAN), metropolitan area network (MAN), wide area network (WAN), virtual private network (VPN), Intranet, or any other appropriate architecture or system that facilitates communications in a network environment. IP network 20 may implement a UDP/IP connection and use a TCP/IP communication language protocol in particular embodiments of the present disclosure. However, IP network 20 may alternatively implement any other suitable communication protocol for transmitting and receiving data packets within communication system 10.

In one example implementation, server 40 can be used in order to offer metrics associated with proof of effectiveness of content being played on display 16. This proof of effectiveness can include eye gaze metrics being processed by server 40. Note that server 40 has the intelligence to pinpoint which part of the content attracted certain eye gaze levels. A simple record could be created to reflect these eye gaze levels at specific time intervals during the content play. For example, a simple record could be generated that indicates that at 1:00 PM (on a certain date), five spectators (two children and three adults) stopped to view content on display 16, and eye gaze levels rose in the two children when a cartoon character emerged during the advertisement. Thus, the video data and the individual data can be processed in order to generate an integrated data file that includes time intervals associated with when the video data was displayed and when the individual data occurred.

Server 40 is configured to control set-top box 50 and, in one implementation, control advertising content to be played by a digital media player, which could be resident in set-top box 50. Server 40 may also be configured to control image recording module 38 within camera 14. For example, server 40 may send instructions about when and how to record certain video or individualistic data. In one example communication, server 40 is configured to control all of the image capture operations associated with communication system 10. Server 40 can be provisioned by an administrator, a digital signage network owner, or by an advertising entity for rendering content on display 16.

Server 40 can be configured to offer detailed reporting and/or exporting functionalities to determine the content/asset being played at the digital media player (e.g., provided within set-top box 50). In addition, server 40 can offer enhanced and granular features to delete specific content and playlists associated with advertisements. Server 40 can be configured to schedule new content/playlists independently, and without deleting the previous content. Additionally, server 40 can be configured to specify playlists/presentations in mixed mode (i.e., some content may be local and some may not be local). In other instances, server 40 can provide detailed reporting of failures and errors of content downloads. Server 40 can also be configured to store, aggregate, process, export, or otherwise maintain content logs in any appropriate format (e.g., an .xls format).

Set-top box 50 is an audiovisual device capable of fostering the delivery of any type of information to be rendered by display 16. Set-top box 50 could include a digital media player in certain embodiments. As used herein in this Specification, the term 'set-top box' is inclusive of any type of a digital video recorder (DVR), a digital video disc (DVD) player, a digital video recorder (DVR), a proprietary box (such as those provided in hotel environments), a TelePresence device, an AV switchbox, an AV receiver, a digital media player, or any other suitable device or element that can receive and process information. Set-top box 50 may interface with display 16 through a wireless connection, or via one or more cables or wires that allow for the propagation of signals between these two elements. Set-top box 50 and display 16 can receive signals from an intermediary device, a remote control, etc. and the signals may leverage infrared, Bluetooth, WiFi, electromagnetic waves generally, or any other suitable transmission protocol for communicating data (e.g., potentially over a network) from one element to another. Virtually any control path can be leveraged in order to deliver information between set-top box 50 and display 16. Transmissions between these two devices can be bidirectional in certain embodiments such that the devices can interact with each other. This would allow the devices to acknowledge transmissions from each other and offer feedback where appropriate.

Set-top box 50 can be configured or otherwise programmed to play content on display 16 at specific times and/or specific locations. This programming may be directed by a digital signage network operator, or by some other appropriate entity relegated the task of managing content for their display stations. Set-top box 50 can be consolidated with server 40 in any suitable fashion. In certain embodiments, set-top box 50 (potentially inclusive of a digital media player), server 40, camera 14, and display 16 can be provided (e.g., integrated) into a single package in which their communications are effectively coordinated and managed. This can include the ability to achieve network communications amongst at least some of the devices. Any of these devices can be consolidated with each other, or operate independently based on particular configuration needs.

Server 40 is a network element that facilitates data flows between endpoints and a given network (e.g., for networks such as those illustrated in FIG. 1). As used herein in this Specification, the term 'network element' is meant to encompass routers, switches, gateways, bridges, loadbalancers, firewalls, servers, processors, modules, or any other suitable device, component, element, or object operable to exchange information in a network environment. Server 40 and/or camera 14 may include image recording module 38 and/or processors to support the activities associated with evaluating content transmissions (e.g., inclusive of proof of play, proof of effectiveness, etc.) associated with particular flows, as outlined herein. Moreover, these elements may include any suitable hardware, software, components, modules, interfaces, or objects that facilitate the operations thereof. This may be inclusive of appropriate algorithms and communication protocols that allow for the effective exchange of data or information.

In one implementation, server 40 and camera 14 include software to achieve (or to foster) the content evaluation operations, as outlined herein in this Specification. Note that in one example, these elements can have an internal structure (e.g., with a processor, a memory element, etc.) to facilitate some of the operations described herein. In other embodiments, these content evaluation features may be provided externally to these elements or included in some other device to achieve this intended functionality. Alternatively, server 40 and camera 14 include this software (or reciprocating software) that can coordinate with each other in order to achieve the operations, as outlined herein. In still other embodiments, one or both of these devices may include any suitable algorithms, hardware, software, components, modules, interfaces, or objects that facilitate the operations thereof.

Figure 2:
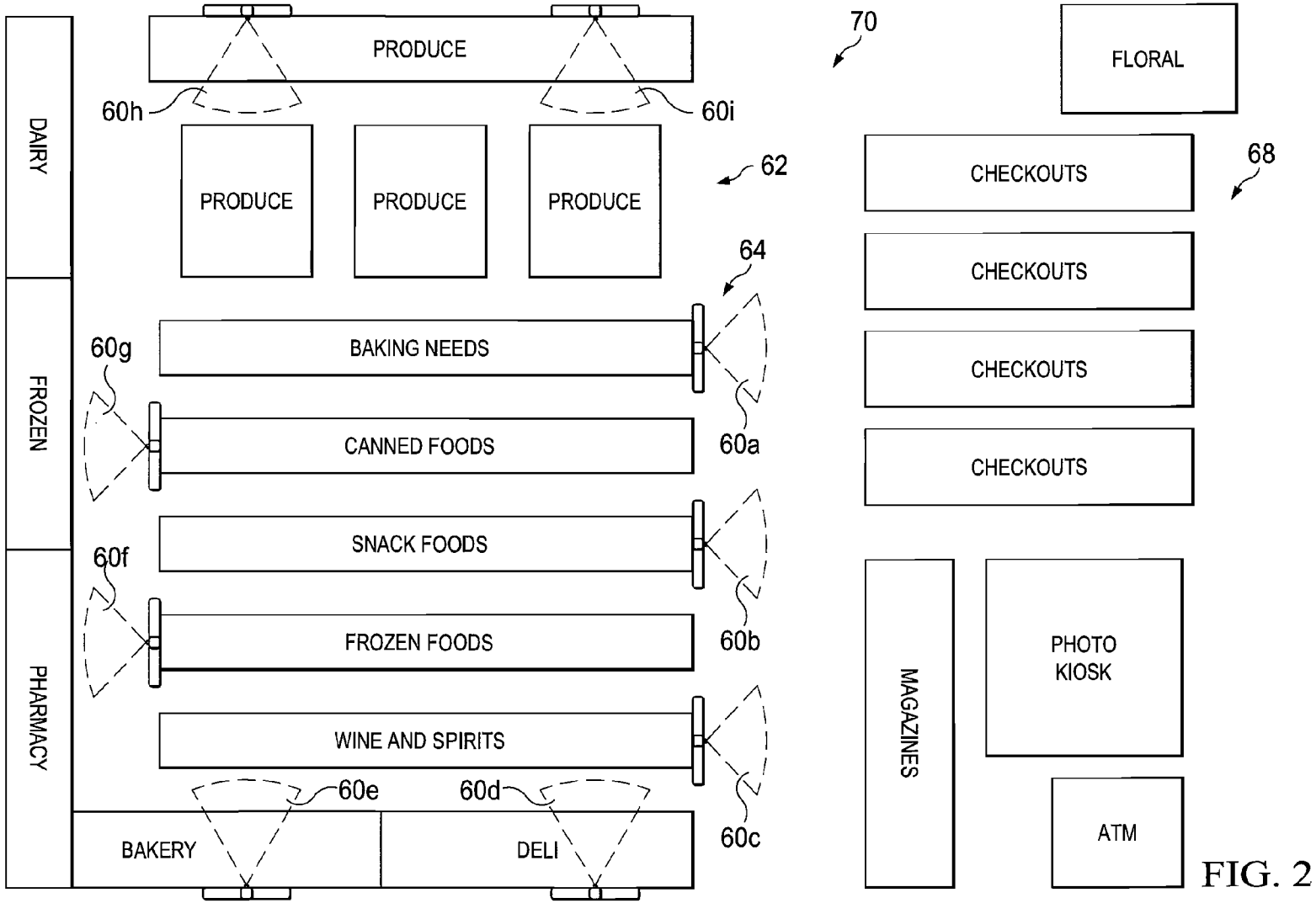
FIG. 2 is a simplified block diagram illustrating one example grocery store environment associated with the communication system.

Turning to FIG. 2, FIG. 2 is a simplified block diagram of a communication system 70, which is operating in an example environment that can implement certain functions outlined herein. Communication system 70 is operating in a grocery store environment in which different sections of the grocery store are using digital signage to provide content to customers who are shopping. FIG. 2 depicts multiple produce sections 62, several aisles 64 (e.g., associated with baking needs, canned foods, snack foods, frozen foods, wine and spirits, bakery, deli, etc.), along with several checkout stations 68. Several aisles include mountings for display systems 60*a-i*, which can offer digital signage (i.e., content) to pedestrians and shoppers walking in the grocery store. Display systems 60*a-i* can include a suitable display, camera, server, set-top box, digital media player, etc. as explained previously in the context of communication system 10. Alternatively, display systems 60*a-i* can include one or more of these items, or different configurations based on the needs at this particular grocery store environment.

Figure 3:
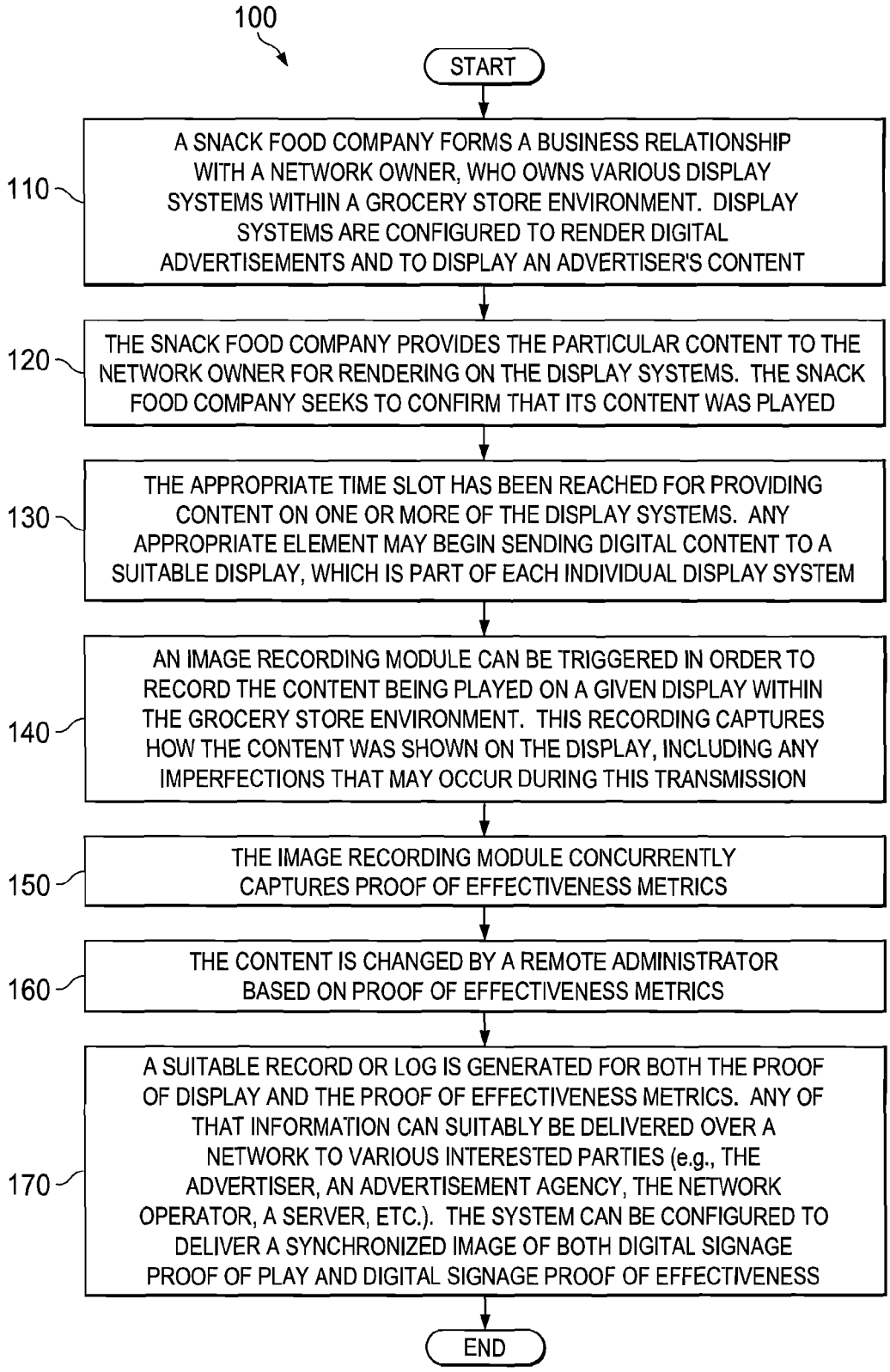
FIG. 3 is a simplified flow diagram illustrating potential operations associated with the communication system.

FIG. 3 is a simplified flow diagram 100 illustrating several example steps associated with an example operation of communication system 70. FIG. 3 is described in conjunction with the environment of FIG. 2. The flow may begin at step 110, where a snack food company forms a business relationship with a network owner, who owns various display systems 60*a-i* within a grocery store environment, which is depicted by FIG. 2. Display systems 60*a-i* are capable of rendering advertisements (e.g., video, audio, or text content) and, further, configured or programmed to broadcast an advertiser's content at designated time intervals.

At step 120, the snack food company provides the particular content to the network owner for rendering on display systems 60*a-i* at prescribed time intervals. The snack food company seeks to confirm that its content was played, as outlined by the business relationship negotiated between the network operator and the snack food company. At step 130, the appropriate time slot has been reached for providing content on one or more of display systems 60*a-i*. Any appropriate element (e.g., set-top box 50 operating in conjunction with server 40) may begin sending digital content to a suitable display or screen, which is part of each individual display system 60*a-i*.

At step 140, image recording module 38 can be triggered in order to record the content being played on a given display within the grocery store environment. This recording can capture how (e.g., in specific terms) the content was shown on the display, including any imperfections that may occur during this transmission (e.g., obstructions on the display, interruptions in the video stream while the content was being played, operational malfunctions associated with any component of the associated display system, etc.). This image recording activity is associated with a proof of display, which can verify that the appropriate content was rendered on a given screen, for the appropriate length of time, in the correct format, etc.

Concurrently, and as depicted at step 150, image recording module 38 can also capture proof of effectiveness metrics. In one example, eye gaze levels are tracked for consumers that stopped to watch the content being played. In another example, the proof of effectiveness includes monitoring the number of individuals that watch the content being played. In still another example, the proof of effectiveness includes monitoring the length of time spent by each individual customer in watching the content. All of this individual data can include corresponding time intervals in which the eye gazing, watching, inching closer to the display, etc. occurred.

At step 160, content is changed by a remote administrator (e.g., the network owner, a network operator, the advertiser, etc.). For example, an advertiser may identify (e.g. through proof of effectiveness metrics) that certain content is not engaging the consumer. Alternatively, the advertiser may identify that a certain population, or demographic may enjoy different types of content. For example, an advertiser could see children being the dominant consumer in this particular environment. In a somewhat real-time manner, the advertiser can alter the display programming and, further, deliver different content to accommodate this particular group (e.g., play more cartoon characters or more animated content that would target this particular child demographic).

At step 170, a suitable record (i.e., an entry, a log, a file, an object, etc.) is generated for both the proof of display and the proof of effectiveness metrics. Any of that information can suitably be delivered over a network to various interested parties (e.g., the advertiser, an advertisement agency, the network operator, a server, etc.). This data can be suitably processed by any authorized party (or device) in order to deliver an intelligent assessment of the content displayed and, further, its associated effectiveness. Thus, the system can be configured to deliver a synchronized image of both digital signage proof of play and digital signage proof of effectiveness.

Note that in certain example implementations, the content evaluation (inclusive of proof of play and proof of effectiveness) functions outlined herein may be implemented by logic encoded in one or more tangible media (e.g., embedded logic provided in an application specific integrated circuit [ASIC], digital signal processor [DSP] instructions, software [potentially inclusive of object code and source code] to be executed by a processor, or other similar machine, etc.). In some of these instances, a memory element [as shown in FIG. 1] can store data used for the operations described herein. This includes the memory element being able to store software, logic, code, or processor instructions that are executed to carry out the activities described in this Specification. A processor can execute any type of instructions associated with the data to achieve the operations detailed herein in this Specification. In one example, the processor [as shown in FIG. 1] could transform an element or an article (e.g., data) from one state or thing to another state or thing. In another example, the activities outlined herein may be implemented with fixed logic or programmable logic (e.g., software/computer instructions executed by a processor) and the elements identified herein could be some type of a programmable processor, programmable digital logic (e.g., a field programmable gate array [FPGA], an erasable programmable read only memory (EPROM), an electrically erasable programmable ROM (EEPROM)) or an ASIC that includes digital logic, software, code, electronic instructions, or any suitable combination thereof.

In one example implementation, server 40 and camera 14 include software in order to achieve the content evaluation functions outlined herein. These activities can be facilitated by processors and/or image recording module 38. Both server 40 and/or camera 14 can include memory elements for storing information to be used in achieving the intelligent content evaluation operations as outlined herein. Additionally, each of these devices may include a processor that can execute software or an algorithm to perform the intelligent content evaluation activities as discussed in this Specification. These devices may further keep information in any suitable memory element [random access memory (RAM), ROM, EPROM, EEPROM, ASIC, etc.], software, hardware, or in any other suitable component, device, element, or object where appropriate and based on particular needs. Any of the memory items discussed herein (e.g., database, table, key, etc.) should be construed as being encompassed within the broad term 'memory element.' Similarly, any of the potential processing elements, modules, and machines described in this Specification should be construed as being encompassed within the broad term 'processor.' Each of the network elements can also include suitable interfaces for receiving, transmitting, and/or otherwise communicating data or information in a network environment.

Note that with the example provided above, as well as numerous other examples provided herein, interaction may be described in terms of two, three, or four network elements. However, this has been done for purposes of clarity and example only. In certain cases, it may be easier to describe one or more of the functionalities of a given set of flows by only referencing a limited number of network elements. It should be appreciated that communication system 10 (and its teachings) are readily scalable and can accommodate a large number of components, as well as more complicated/sophisticated arrangements and configurations. Accordingly, the examples provided should not limit the scope or inhibit the broad teachings of communication system 10 as potentially applied to a myriad of other architectures.

It is also important to note that the steps in the preceding flow diagrams illustrate only some of the possible signaling scenarios and patterns that may be executed by, or within, communication system 10. Some of these steps may be deleted or removed where appropriate, or these steps may be modified or changed considerably without departing from the scope of the present disclosure. In addition, a number of these operations have been described as being executed concurrently with, or in parallel to, one or more additional operations. However, the timing of these operations may be altered considerably. The preceding operational flows have been offered for purposes of example and discussion. Substantial flexibility is provided by communication system 10 in that any suitable arrangements, chronologies, configurations, and timing mechanisms may be provided without departing from the teachings of the present disclosure.

Although the present disclosure has been described in detail with reference to particular arrangements and configurations, these example configurations and arrangements may be changed significantly without departing from the scope of the present disclosure. For example, although the present disclosure has been described with reference to particular communication exchanges involving certain server components, communication system 10 may be applicable to other protocols and arrangements (e.g., those involving any type of digital media player). Additionally, although camera 14 has been described as being mounted in a particular fashion, camera 14 could be mounted in any suitable manner in order to capture proof of display and proof of effectiveness characteristics. Other configurations could include suitable wall mountings, aisle mountings, furniture mountings, cabinet mountings, etc., or arrangements in which cameras would be appropriately spaced or positioned to perform its functions. Additionally, communication system 10 can have direct applicability in TelePresence environments such that proof of play and proof of effectiveness can be tracked during video sessions. A TelePresence screen can be used in conjunction with a server in order to capture what was played on the screen and, further, the audience's individual data associated with that rendering. Moreover, although communication system 10 has been illustrated with reference to particular elements and operations that facilitate the communication process, these elements and operations may be replaced by any suitable architecture or process that achieves the intended functionality of communication system 10.

What is claimed is:

1. A method, comprising:

recording, by a camera, video data associated with a display;

recording individual data associated with one or more audience members witnessing the video data on the display, wherein the video data and the individual data are recorded in a substantially concurrent manner;

interfacing with an optical element that comprises a mirror proximate to the display and that reflects images to be recorded by the camera; and communicating the video data and the individual data over a network to a next destination, wherein the camera is configured to receive instructions from a server, and wherein the mirror is a convex mirror.

2. The method of claim 1, further comprising:

receiving programming instructions for the video data; and transmitting the video data to a set-top box configured to communicate with the display.

3. The method of claim 1, further comprising:

processing the video data and the individual data in order to generate an integrated data file that includes time intervals associated with when the video data was played and when the individual data was collected.

4. The method of claim 1, further comprising:

tracking eye gaze metrics for one or more of the audience members, wherein the eye gaze metrics are included within the individual data.

5. The method of claim 1, further comprising:

identifying a number of the audience members proximate to the display during particular time intervals associated with particular content within the video data, wherein the number of the audience members is included as part of the individual data.

6. Logic encoded in non-transitory computer readable media that includes code for execution and when executed by a processor operable to perform operations comprising:

recording video data associated with a display;

recording individual data associated with one or more audience members witnessing the video data on the display, wherein the video data and the individual data are recorded in a substantially concurrent manner;

interfacing with an optical element that comprises a mirror proximate to the display and that reflects images to be recorded by a camera; and communicating the video data and the individual data over a network to a next destination, wherein the camera is configured to receive instructions from a server, and wherein the mirror is a convex mirror.

7. The logic of claim 6, wherein the operations further comprise:

receiving programming instructions for the video data; and transmitting the video data to a set-top box configured to communicate with the display.

8. The logic of claim 6, wherein the operations further comprise:

processing the video data and the individual data in order to generate an integrated data file that includes time intervals associated with when the video data was played and when the individual data was collected.

9. The logic of claim 6, wherein the operations further comprise:

tracking eye gaze metrics for one or more of the audience members, wherein the eye gaze metrics are included within the individual data.

10. The logic of claim 6, the operations further comprising:

identifying a number of the audience members proximate to the display during particular time intervals associated with particular content within the video data, wherein the number of the audience members is included as part of the individual data.

11. An apparatus, comprising:

a memory element configured to store data, a processor operable to execute instructions associated with the data, and a recording module configured to:

record video data associated with a display;

record individual data associated with one or more audience members witnessing the video data on the display, wherein the video data and the individual data are recorded in a substantially concurrent manner;

interface with an optical element that comprises a mirror proximate to the display and that reflects images to be recorded by the apparatus; and communicate the video data and the individual data over a network to a next destination, wherein the apparatus is a camera is configured to receive instructions from a server, and wherein the mirror is a convex mirror.

12. The apparatus of claim 11, wherein the server is further configured to process the video data and the individual data in order to generate an integrated data file that includes time intervals associated with when the video data was played and when the individual data was collected.

13. The apparatus of claim 11, further comprising:

a set-top box configured to communicate with the display, wherein the set-top box includes a digital media player configured to play content within the video data.

14. The apparatus of claim 11, wherein eye gaze metrics for one or more of the audience members are tracked, wherein the eye gaze metrics are included within the individual data.

* * * * *